US005485077A

United States Patent [19]

Werrbach

[11] Patent Number: 5,485,077

[45] Date of Patent: Jan. 16, 1996

[54] CONCENTRIC SERVO VOLTAGE REGULATOR UTILIZING AN INNER SERVO LOOP AND AN OUTER SERVO LOOP

[75] Inventor: Donn Werrbach, Burbank, Calif.

[73] Assignee: Aphex Systems, Ltd., Sun Valley, Calif.

[21] Appl. No.: 103,522

[22] Filed: Aug. 9, 1993

[51] Int. Cl.[6] ..... G05F 1/44

[52] U.S. Cl. ..... 323/286; 323/285

[58] Field of Search ..... 323/273, 274, 323/275, 280, 281, 282, 284, 285, 286; 363/79, 21, 23, 25, 97

[56] References Cited

U.S. PATENT DOCUMENTS

| | | | |
|---|---|---|---|
| 3,315,149 | 4/1967 | Strait et al. | 323/277 |
| 3,986,101 | 10/1976 | Koetsch et al. | 323/275 |
| 4,254,372 | 3/1981 | Moore, Jr. | 323/277 |
| 4,321,525 | 3/1982 | Imazeki et al. | 363/281 |
| 4,326,245 | 4/1982 | Saleh | 323/79 |
| 4,327,319 | 4/1982 | Swisher et al. | 323/303 |
| 4,481,462 | 11/1984 | de Kleijn | 323/274 |
| 4,502,152 | 2/1985 | Sinclair | 455/73 |
| 4,543,522 | 9/1985 | Moreau | 323/303 |
| 4,728,901 | 3/1988 | Pepper | 323/273 X |
| 4,771,226 | 9/1988 | Jones | 323/303 |
| 4,866,585 | 9/1989 | Das | 363/8 |
| 4,983,905 | 1/1991 | Sano et al. | 323/274 |

OTHER PUBLICATIONS

IBM Technical Disclosure Bulletin, vol. 21, No. 2, authored by J. S. Tung, published in Jul. 1978 for "Controlled Saturation Compensation for Power Amplifier".

R. F. Graf, "The Encyclopedia of Electronic Circuits", 1985, pp. 280, 288, 501.

*Primary Examiner*—Peter S. Wong
*Assistant Examiner*—Y. Jessica Han
*Attorney, Agent, or Firm*—Thomas I. Rozsa; Tony D. Chen

[57] ABSTRACT

The present invention is a concentric servo method and apparatus using two servo loops to control and stabilize the output of an electronic voltage regulator. An inner and outer servo loop are employed. The inner servo loop resembles the control loop of a conventional voltage regulator while the outer servo loop controls the sense threshold of the inner servo loop. The outer servo loop senses the voltage delivered to an external load resistance and controls the sense threshold of the inner servo loop to compensate for the voltage loss which may occur between the regulator output and the actual load resistance. The inner loop retains its high speed to regulate out any input voltage irregularities such as ripple and noise. The present invention gives better stability than conventional remote sensing voltage regulator circuits.

29 Claims, 5 Drawing Sheets

Circuit Equivalencies

CONCENTRIC SERVO VOLTAGE REGULATOR UTILIZING AN INNER SERVO LOOP AND AN OUTER SERVO LOOP

BACKGROUND OF THE INVENTION

1. Field of the Invention

The present invention generally relates to the field of electronic equipment. More particularly, the present invention relates to the field of voltage regulated power supplies or voltage regulators.

2. Description of the Prior Art

Voltage regulated power supplies or voltage regulators are widely used in electrical and electronics industries.

Today, switchmode regulated power supplies have become commonplace in the computer industry and have the advantage of high power efficiency compared to linear regulators. A prior art switchmode voltage regulator typically consists of a voltage adjuster and a servo loop which operate as follows. An unregulated DC voltage is fed into the voltage adjuster. The voltage adjuster produces a controlled output voltage and receives a control input from the servo loop. The servo loop senses the output voltage of the voltage adjuster and sends a suitable correction signal to the voltage adjuster to cause the output voltage to remain at a predetermined level.

One of the disadvantages of the prior art voltage regulators is that the relatively high output noise of switchmode power supplies has generally prevented their use in analog equipment. Although adding a subsequent filter can make switchmode power supplies suitable for many analog system applications, the additional time delay of the secondary filter can cause instability of the regulation servo loop, especially with remote sensing. In addition, if the servo loop is more heavily compensated to reduce the instability, i.e., the loop filter made slower, the ability to dynamically eliminate rectifier ripple at the output is reduced.

It is desirable to provide a new voltage regulator which can overcome all of the problems of the prior art switchmode voltage regulators, and is suitable for use in more critical systems where excellent regulation and low output noise are required.

SUMMARY OF THE INVENTION

The present invention is a concentric servo voltage regulator. The primary object of the present invention is to provide a voltage regulator which can be used in many critical electronic systems where superior voltage regulation and low output noise are demanded.

In the present invention, the concentric servo voltage regulator utilizes two servo loops to control and stabilize the output of an electronic voltage regulator. The present invention utilizes an inner servo loop and an outer servo loop. The inner servo loop is similar to the control loop of a conventional voltage regulator, while the outer servo loop senses the voltage delivered to an external load resistance and controls the sense threshold of the inner servo loop to compensate for the voltage loss which may occur between the regulator output and the actual load resistance. The inner servo loop retains its high speed to regulate out any input voltage irregularities such as ripple and noise. The present invention provides a better stability than conventional remote sensing voltage regulator circuits.

In operation, an unregulated voltage is supplied to the voltage adjuster. The regulated output voltage from the voltage adjuster is conducted to the load through a conductor resistance and receives the regulated output voltage. The assumed load, therefore, causes a voltage drop to appear across the external conductor.

The inner servo loop is comprised of a comparator and a loop filter. A first input receives a sample of the voltage output and a second input receives a reference voltage from the outer servo loop. The comparator generates a logical high or low error output depending upon whether the sensed voltage of the first input is higher or lower than the reference voltage of the second input. The output of the comparator is filtered by the loop filter. The output of the loop filter represents a suitable means for controlling the voltage adjuster. The is voltage adjuster control causes the voltage output to be reduced if the comparator error indicates the output is too high, and to be increased if the comparator error indicates the output is too low. The inner servo loop thereby causes the voltage adjuster to keep the voltage output equal to the reference voltage input.

The output of the outer servo loop output is coupled to the voltage reference input of the inner servo loop for the purpose of establishing a certain voltage output through the action of the inner servo loop as previously described. The outer servo loop comprises a reference voltage, a comparator and a loop filter. A first input receives a sample of the actual load voltage and a second input receives the reference voltage. The comparator generates a logical high or low error output depending upon whether the sensed voltage of the first input is higher or lower than the reference voltage of the second input. The output of the comparator is filtered by the loop filter and coupled to the comparator to serve as a reference voltage to the inner servo loop. The polarity and sense of the comparator and loop filter are such that if the voltage at a point is greater than the reference voltage, then the output of the outer servo loop decreases. The outer servo loop generates a variable sense threshold for the inner servo loop. By this action, the inner servo loop will produce an output voltage great enough to overcome the loss incurred by the conductor resistance and produce an output voltage on the load equal to the reference voltage.

Described generally, the present invention is a concentric servo method and apparatus using two servo loops to control and stabilize the output of an electronic voltage regulator. In the present invention, an inner and outer servo loop are employed. The inner servo loop resembles the control loop of a conventional voltage regulator while the outer servo loop controls the sense threshold of the inner servo loop. The outer servo loop senses the voltage delivered to an external load resistance and controls the sense threshold of the inner servo loop to compensate for the voltage loss which may occur between the regulator output and the actual load resistance. The inner loop retains its high speed to regulate out any input voltage irregularities such as ripple and noise. The major advantage of the present invention is that it gives better stability than conventional remote sensing voltage regulator circuits.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
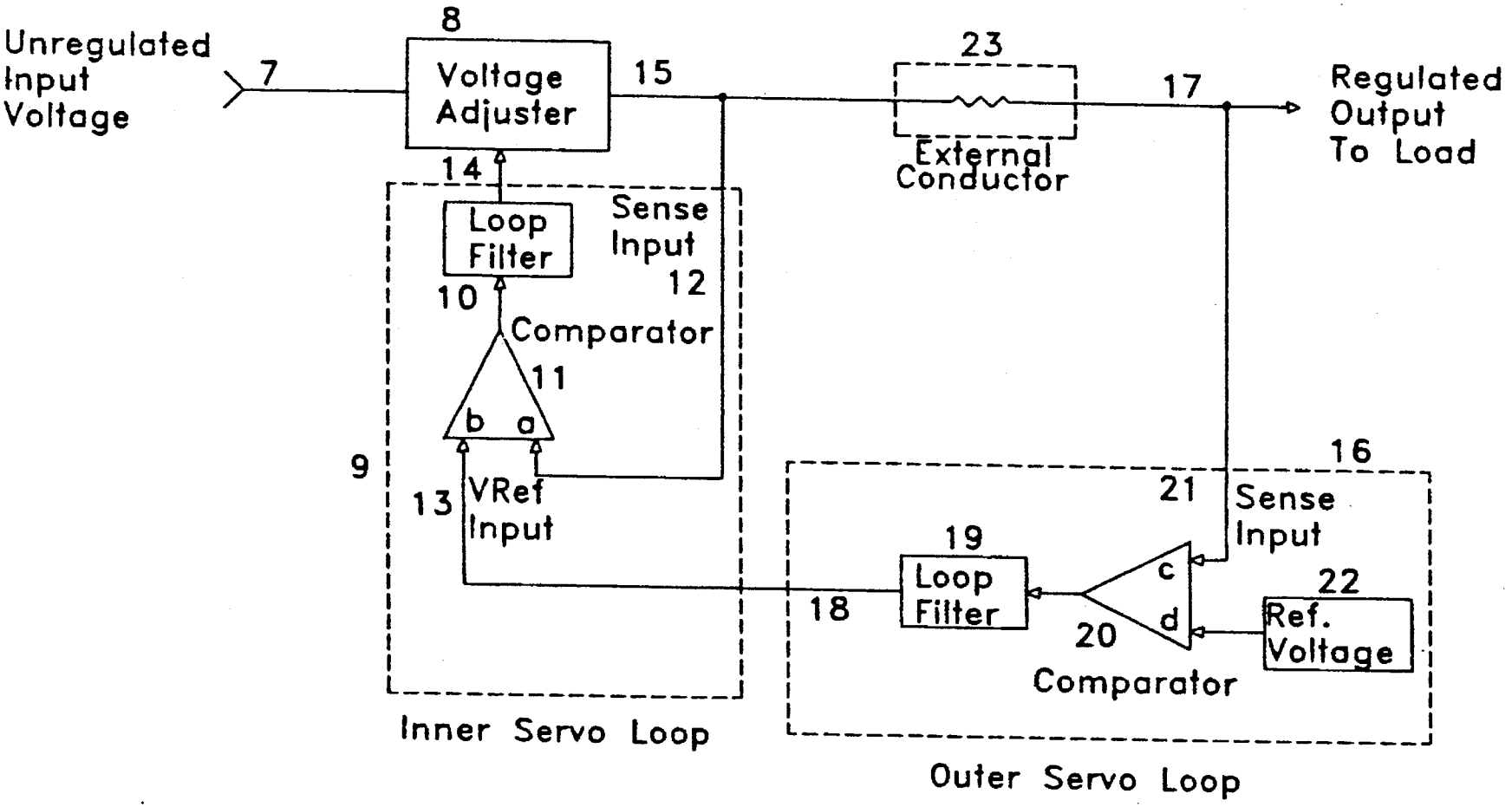
FIG. 1 is an illustrative block diagram showing one of the preferred embodiments of the present invention concentric voltage regulator, using a variable inner loop reference.

Referring to FIG. 1, there is shown an illustrative block diagram showing one of the preferred embodiments of the present invention concentric voltage regulator, using a variable inner loop reference. An unregulated voltage is supplied to the voltage adjuster 8 by means of line 7. The regulated output of the voltage adjuster appears on line 15 and the output voltage is conducted to the load through a conductor resistance 23. An assumed load resistance is connected to point 17 to receive the regulated output voltage and consume power. The assumed load, therefore, causes a voltage drop to appear across said external conductor.

The inner servo loop 9 is composed of a comparator 11 and a loop filter 10. The comparator receives two inputs labeled "a" and "b". The first input "a" receives a sample of the voltage adjuster output from line 15. The second input "b" receives a reference voltage from the outer servo loop 16. Comparator 11 generates a logical high or low error output depending upon whether the sensed voltage of the first input "a" is higher or lower than the reference voltage of the second input "b". The comparator output is filtered by the loop filter 10. The loop filter output is coupled to line 14 which represents a suitable means of controlling the voltage adjuster. The voltage adjuster control causes the output at line 15 to reduce if the comparator error indicates the said output is too high, and increase if the comparator error indicates the said output is too low. The inner servo loop 9 thereby causes the voltage adjuster to keep the voltage at line 15 equal to the voltage reference input 13.

The outer servo loop 16 produces an output at line 18 which is coupled to the voltage reference input of the inner servo loop at line 13 for the purpose of establishing a certain output voltage at line 15 through the action of the inner servo loop 9 as previously described. The outer servo loop 16 is comprised of a reference voltage 22, a comparator 20, and a loop filter 19. The comparator has two inputs labeled "c" and "d". The first input "c" receives a sample of the actual upon load voltage at point 17. The second input "d" receives the reference voltage 22. Comparator 20 generates a logical high or low error output depending upon whether the sensed voltage of the first input "c" is higher or lower than the reference voltage of the second input "d". The comparator output is filtered by the loop filter 19 and coupled to the second input "b" of the inner servo loop comparator 11 to serve as a reference voltage to the inner servo loop, as previously described. The polarity and sense of the outer servo loop comparator 20 and loop filter 19 are such that if the voltage at point 17 is greater than the reference voltage 22, then the output at 18 decreases. The outer servo loop 16 therefore generates what can be considered a variable sense threshold for the inner servo loop 9. By this action, the inner servo loop will produce an output voltage at line 15 great enough to overcome the loss incurred by the conductor resistance 23, and produce an output voltage on the load at point 17 equal to the reference voltage 22.

Figure 2:
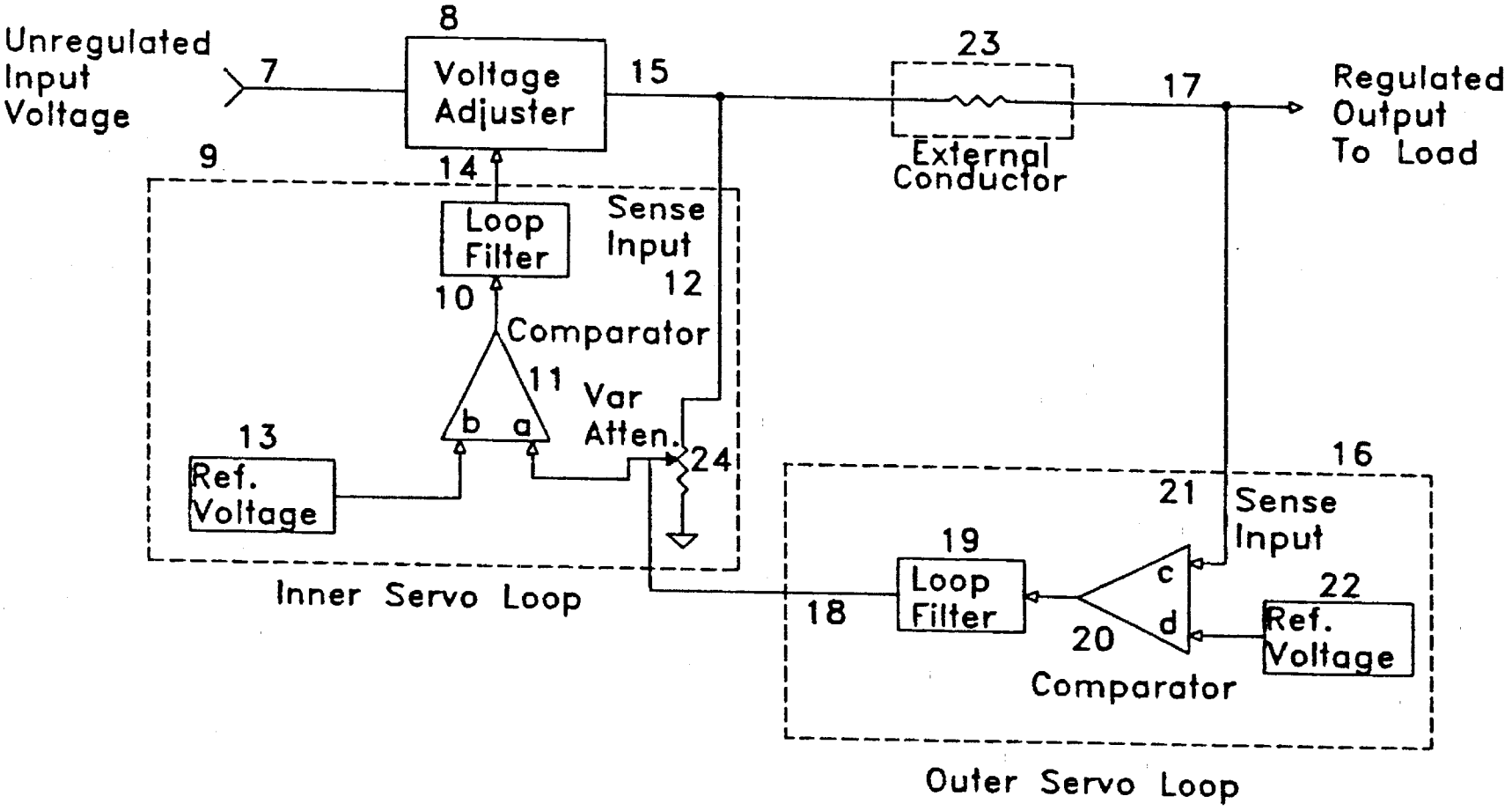
FIG. 2 is an illustrative block diagram showing another one of the preferred embodiments of the present invention concentric voltage regulator, using a variable inner loop sense divider.

Referring to FIG. 2, there is shown an illustrative block diagram showing another one of the preferred embodiments of the present invention concentric voltage regulator, using a variable inner loop sense divider. This illustrates a second method of achieving the variable sense threshold for the inner servo loop 9. By making the variable attenuator 24 responsive to the control signal 18, an equivalent functional system to that shown in FIG. 1 is produced. The variable attenuator 24 receives a control input from the outer servo loop 16 on line 18 which causes the variable attenuator 24 to decrease attenuation if the outer loop senses the voltage at point 17 is higher than the reference voltage 22. The decreased attenuation of 24 causes the sense threshold to become lower, causing the output at line 15 to become reduced until the voltage at point 17 is equal to the reference voltage 22. It is noted that both the systems of FIG. 1 and FIG. 2 should be considered as identical because they both utilize a form of variable sense threshold within the inner servo loop 9.

Figure 3:
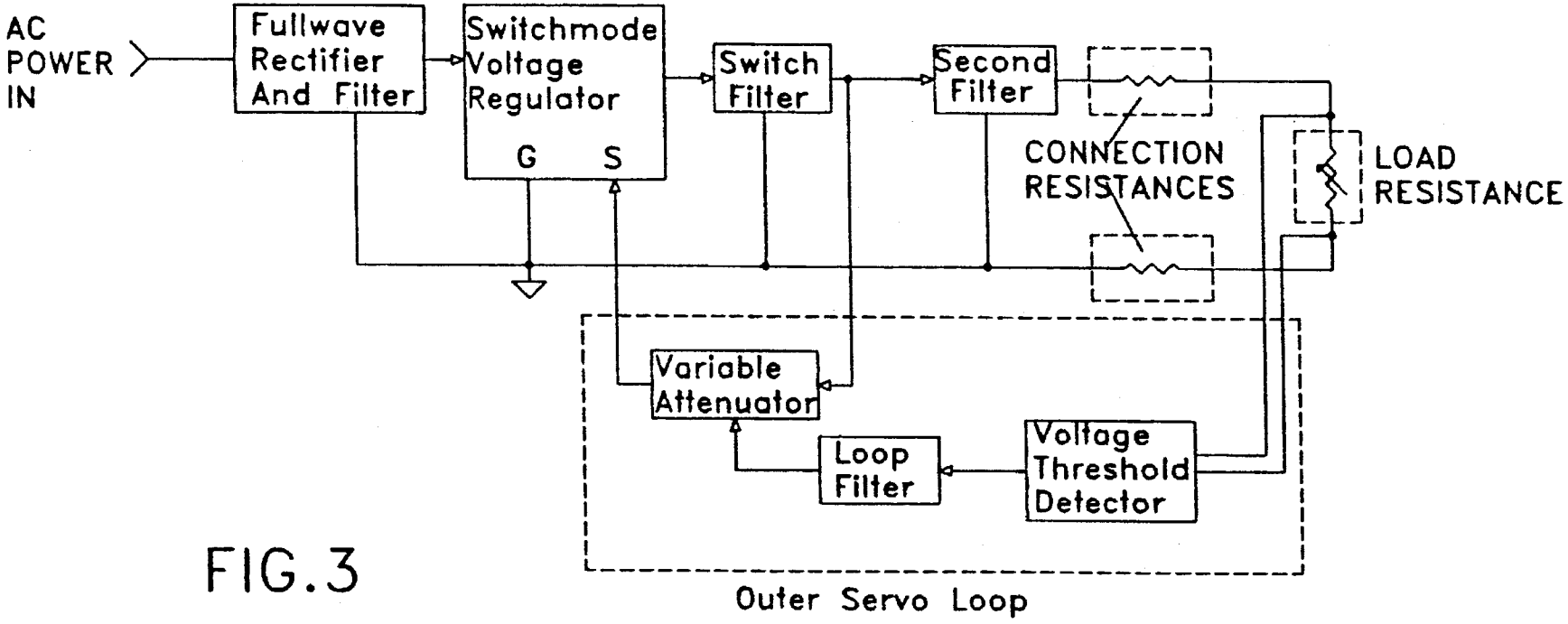
FIG. 3 is an illustrative block diagram showing a practical implementation of the present invention concentric voltage regulator.
Figure 4:
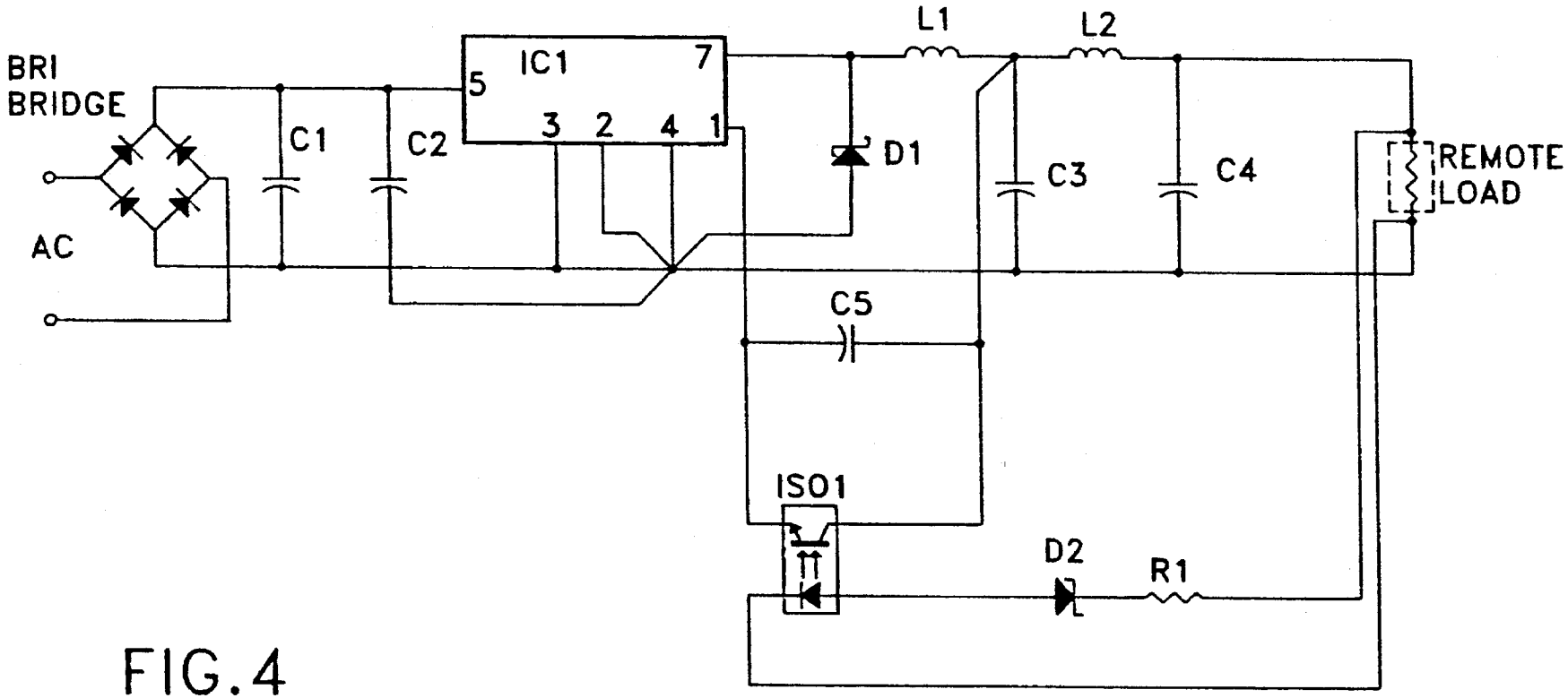
FIG. 4 is a detailed circuitry diagram showing a practical implementation of the present invention concentric voltage regulator.

Referring to FIGS. 3 and 4, there are shown a practical implementation of the present invention concentric voltage regulator. FIG. 3 is a block diagram and FIG. 4 is a detailed circuitry diagram. IC1 is an integrated circuit (IC) switch-mode voltage regulator. By way of example only, IC1 is an industry standard LM2574-5 IC chip. Basically, IC1 contains in itself an inner servo loop. Access to the voltage sense input of IC1 is available through pin 1. The sense threshold is controlled through the use of a variable attenuator on the voltage sense input. This is the only method available with the LM2574-5 IC chip because the voltage reference is an inaccessible point within the IC itself.

An unregulated DC voltage is developed by the 18VAC input and the full wave 4-diode bridge rectifier of BR1 and capacitors C1 and C2 in a conventional manner. By way of example only, capacitor C1 is 1,000 μF, and capacitor C2 is 47 μF. IC1 pin 5 acts as the voltage controller input 7 of FIG. 2, to receive the unregulated input voltage. Pins 2, 3, and 4 of IC1 are merely IC circuit grounds. Pin 7 of IC1 is the switched voltage output which, after integration by inductor L1 and capacitor C3, produces a controlled output equivalent to line 15 of FIG. 2. Inductor L1, capacitor C3 and diode D1 serve as a switch filter. By way of example only, diode D1 is an industry standard 11DQ06 type diode, inductor L1 is 1 mH and capacitor C3 is 330 μF. Inductor L2 and capacitor C4 act as a secondary noise filter to produce a cleaner DC output. By way of example only, inductor L2 is 300 μH and capacitor C4 is 330 μF. The resistance of inductor L2 plus the resistance of all wires connecting the remote load to the circuit may be considered equivalent to the resistance of the external conductor 23 of FIG. 2.

The circuit of optoisolator ISO1, capacitor C5, diode D2, and resistor R1 serve the function of the outer servo loop 16 of FIG. 2. By way of example only, diode D2 is an industry standard 1N5231B type diode, capacitor C5 is 1 μF, and resistor R1 is 10 KΩ. The variable attenuator function is produced by the variable conductance from collector to emitter of the transistor in ISO1. The node resistance from pin 1 of IC1 to ground is approximately 5,000Ω. This acts as one leg of an "L" attenuator network, while the conductance of ISO1 acts as the other "L" network leg. When the current in ISO1 increases, the effect is to increase the sense voltage level at pin 1 of IC1. This causes the inner servo loop of IC1 to reduce the output voltage of the regulator.

The functions of the outer loop voltage reference and comparator of FIG. 2 are served by the zener breakdown threshold of diode D2 and the turn-on voltage of the light emitting diode (LED) of ISO1. The concentric servo regulator operates in the following manner. Through a separate pair of conductors, the sensed voltage at the remote load is connected to the series circuit of ISO1, diode D2, and resistor R1. When voltage is first applied to the bridge rectifier, no current flows through ISO1 and therefore no sense voltage is available to the inner servo loop of IC1. The output voltage of IC1 rises without any control and remains approximately equal to the unregulated input voltage. When the voltage at the load reaches the outer loop sense threshold determined by the zener breakdown potential plus LED turn-on potential, current begins to flow in the LED of ISO1 causing the conductance of the ISO1 transistor to increase. Resistor R1 limits the current which can flow in the sense loop to protect the optoisolator from destruction, but allows a relatively large amount of current to flow. As the voltage at the external load continues to rise in magnitude, the current through the LED of ISO1 rises sharply causing the conductance of the ISO1 transistor to rise sharply. At this point, the outer servo loop begins to deliver a large enough sense voltage to the inner servo loop to cause the voltage regulator to begin reducing its output voltage. As the unregulated input voltage continues rising to its nominal limit, the output voltage at the load remains constant due to concentric servo control.

Figure 5:
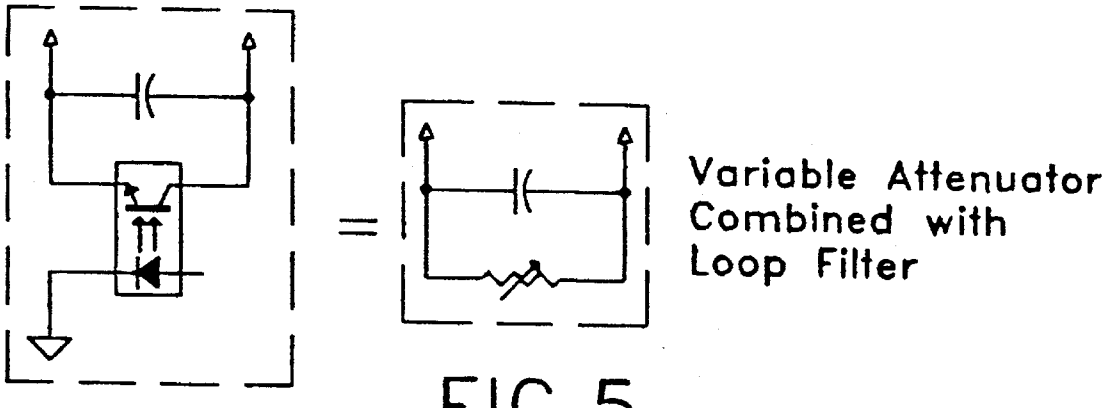
FIG. 5 shows equivalent circuits of a variable attenuator combined with a loop filter.
Figure 6:
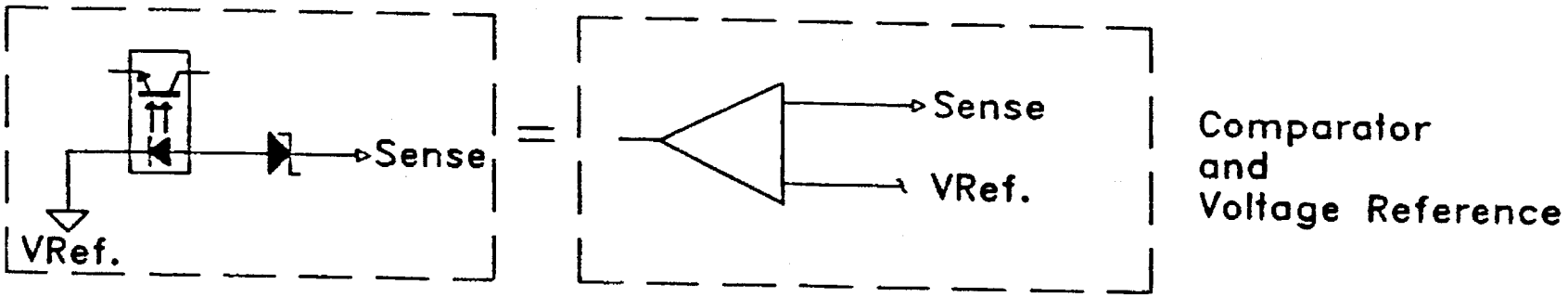
FIG. 6 shows equivalent circuits of a comparator and a voltage reference.

It is understood that the detailed circuit shown in FIG. 4 is merely one of the many possible implementations of the present invention, and there are many other equivalent circuitry components which may be substituted therein. For example, there are shown in FIG. 5 two equivalent circuits of a variable attenuator combined with a loop filter, and there are shown in FIG. 6 two equivalent circuits of a comparator and a voltage reference.

The present invention has many advantageous features. It overcomes all of the problems of the prior art switchmode voltage regulators, such as the relatively high output noise which is unsuitable for use in analog equipment, the instability of the servo loop caused by the time delay if a subsequent filter is added to make prior art switchmode power supplies suitable for analog systems, and the reduced ability to dynamically eliminate rectifier ripple at the output if the servo loop is heavily compensated to reduce the instability. The present invention is suitable for use in more critical systems where excellent regulation and low output noise are required.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A concentric servo voltage regulator comprising:

a. a voltage adjustor having a supply input for receiving a supply voltage, a voltage output for providing a controlled output voltage through a power distribution path to a load, and a control input responsive to a control signal for controlling the level of the output voltage as a function of the control signal;

b. an inner servo loop for generating the control signal for said voltage adjustor and having a sense input coupled to said voltage adjustor output, a first reference input, and a control signal output coupled to said voltage adjustor control input, where the inner servo loop establishes said voltage adjustor output level as a function of the first reference input;

c. an outer servo loop for generating a variable first reference voltage for said inner servo loop and having a voltage sense input coupled directly to the load for sensing an actual load voltage, a second reference input coupled to a reference voltage source, and a control signal output coupled to said first reference input of said inner servo loop, where the outer servo loop maintains control over said inner servo loop;

d. said outer servo loop including a logical comparator for comparing said actual load voltage with said reference voltage source and providing a logical high or low error output when said actual voltage is higher or lower than said reference voltage source, where said error output from said logical comparator is filtered to form said variable first reference voltage by a loop filter; and e. whereby said outer servo loop senses the actual regulated voltage on said load and maintains control over said inner servo loop forcing said inner servo loop to cause said voltage adjustor to adjust and compensate for any voltage losses in said power distribution path, and thereby regulate the actual voltage on said load to the desired level.

2. The invention as defined in claim 1 wherein said inner servo loop further comprises an inner servo loop comparator for comparing a sample of said output voltage of said voltage adjustor and said sense input of said inner servo loop.

3. A concentric servo voltage regulator comprising:

a. a voltage adjustor having an input and an output for outputting a regulated output voltage to a load, the voltage adjustor being responsive to a control signal;

b. an inner servo loop having means for providing said control signal to said voltage adjustor, the inner servo loop including an inner servo loop comparator having means for comparing an inner servo loop reference voltage with a variable sense threshold from a variable attenuator, and generating said control signal when the variable sense threshold is inconsistent with the inner servo loop reference voltage, and the variable attenuator receiving a first sense voltage that is a sample of said regulated output voltage, and being responsive to a variable servo signal; and c. an outer servo loop having means for providing said variable servo signal to said attenuator, the outer servo loop including an outer servo loop comparator having means for comparing a second sense voltage that is a sample of an actual voltage on said load with a reference voltage, and generating said variable servo signal when the second sense voltage is inconsistent with the reference voltage;

d. whereby said outer servo loop can sense the actual voltage on said load and provide said variable servo signal to said inner servo loop, so that said control signal produced by said inner servo loop can cause said voltage adjustor to adjust and compensate any fluctuation in said output voltage, and thereby provide a desirable actual voltage on said load.

4. The invention as defined in claim 3 wherein said inner servo loop further comprises an inner servo loop filter connected between said inner servo loop comparator and said voltage adjustor.

5. The invention as defined in claim 3 wherein said outer servo loop further comprises an outer servo loop filter connected between said outer servo loop comparator and said inner servo loop comparator.

6. The invention as defined in claim 3 further comprising a fullwave rectifier and an input filter connected to said input of said voltage adjustor.

7. The invention as defined in claim 3 further comprising an output filter connected to said output of said voltage adjustor.

8. A concentric servo voltage regulator comprising:

a. a switchmode voltage adjustor having an inner servo loop, an input and an output for outputting a regulated output voltage to a load;

b. a variable attenuator for providing a variable sense threshold to said inner servo loop of said switchmode voltage adjustor, the variable attenuator receiving a first sense voltage that is a sample of said regulated output voltage, and being responsive to a variable servo signal; and c. an outer servo loop having means for providing said variable servo signal to said attenuator, the outer servo loop including an outer servo loop comparator having means for comparing a second sense voltage that is a sample of an actual voltage on said load with a reference voltage, and generating said variable servo signal when the second sense voltage is inconsistent with the reference voltage;

d. whereby said outer servo loop can sense the actual voltage on said load and provide said variable servo signal to said attenuator which in turn provides said variable sense threshold to said inner servo loop of said switchmode voltage adjustor and causes it to adjust and compensate any fluctuation in said output voltage, and thereby provide a desirable actual voltage on said load.

9. The invention as defined in claim 8 wherein said inner servo loop further comprises an inner servo loop filter connected between an inner servo loop comparator and said voltage adjustor.

10. The invention as defined in claim 9 wherein said outer servo loop further comprises an outer servo loop filter connected between said outer servo loop comparator and said inner servo loop comparator.

11. The invention as defined in claim 8 further comprising a fullwave rectifier and an input filter connected to said input of said voltage adjustor.

12. The invention as defined in claim 8 further comprising an output filter connected to said output of said voltage adjustor.

13. A concentric servo voltage regulator comprising:

a. voltage adjustor having an input for receiving an unregulated input voltage, an output for outputting a regulated output voltage to a load, and a control terminal for receiving a control signal;

b. an inner servo loop for providing said control signal to said voltage adjustor, the inner servo loop having an inner servo loop comparator and an inner servo loop filter, the inner servo loop comparator having a first input for receiving a first sense voltage that is a sample of said regulated output voltage, a second input for receiving a variable sense threshold, and an output, the inner servo loop comparator generating a logical high or low error signal at its output when the first sense voltage is higher or lower than the variable sense threshold, and the inner servo loop filter connected between the output of the inner servo loop comparator and said control terminal of said voltage adjustor; and c. an outer servo loop for providing said variable sense threshold to said inner servo loop, the outer servo loop having an outer servo loop comparator and an outer servo loop filter, the outer servo loop comparator having a first input for receiving a second sense voltage that is a sample of an actual voltage on said load, a second input for receiving a reference voltage, and an output, the outer servo loop comparator generating a logical high or low error signal at its output when the second sense voltage is higher or lower than the reference voltage, and the outer servo loop filter connected between the output of the outer servo loop comparator and said second input of said inner servo loop comparator;

d. whereby said outer servo loop can sense the actual voltage on said load and provide said variable sense threshold to said inner servo loop, so that said control signal produced by said inner servo loop can cause said voltage adjustor to adjust and compensate any fluctuation in said output voltage, and thereby provide a desirable actual voltage on said load.

14. The invention as defined in claim 13 further comprising a fullwave rectifier and an input filter connected to said input of said voltage adjustor.

15. The invention as defined in claim 13 further comprising an output filter connected to said output of said voltage adjustor.

16. The invention as defined in claim 13 further comprising an additional filter connected between said first input of said inner servo loop comparator and said first input of said outer ervo loop comparator for preventing interference between said first sense voltage and said second sense voltage.

17. A concentric servo voltage regulator comprising:

a. a voltage adjustor having an input for receiving an unregulated input voltage, an output for outputting a regulated output voltage to a load, and a control terminal for receiving a control signal;

b. an inner servo loop having means for providing said control signal to said voltage adjustor, the inner servo loop having an inner servo loop comparator, an inner servo loop filter and a variable attenuator, the inner servo loop comparator having a first input for receiving an inner servo loop reference voltage, a second input for receiving a variable sense threshold from the variable attenuator, and an output, the inner servo loop comparator generating a logical high or low error signal at its output when the variable sense threshold is higher or lower than the inner servo loop reference voltage, the inner servo loop filter connected between the output of the inner servo loop comparator and said control terminal of said voltage adjustor, and the variable attenuator receiving a first sense voltage that is a sample of said regulated output voltage, and being responsive to a variable servo signal; and c. an outer servo loop having means for providing said variable servo signal to said attenuator, the outer servo loop having an outer servo loop comparator and an outer servo loop filter, the outer servo loop comparator having a first input for receiving a second sense voltage that is a sample of an actual voltage on said load, a second input for receiving a reference voltage, and an output, the outer servo loop comparator generating a logical high or low error signal at its output when the second sense voltage is higher or lower than the reference voltage, and the outer servo loop filter connected between the output of the outer servo loop comparator and said second input of said inner servo loop comparator;

d. whereby said outer servo loop can sense the actual voltage on said load and provide said variable servo signal to said inner servo loop, so that said control signal produced by said inner servo loop can cause said voltage adjustor to adjust and compensate any fluctuation in said output voltage, and thereby provide a desirable actual voltage on said load.

18. The invention as defined in claim 17 further comprising a fullwave rectifier and an input filter connected to said input of said voltage adjustor.

19. The invention as defined in claim 17 further comprising an output filter connected to said output of said voltage adjustor.

20. A concentric servo voltage regulator comprising:

a. a switchmode voltage adjustor having an input for receiving an unregulated input voltage, an output for outputting a regulated output voltage to a load, and a sense input for receiving a control signal, the switchmode voltage adjustor further including an inner servo loop for adjusting the output voltage;

b. a variable attenuator for providing a variable sense threshold to said sense input of said switchmode voltage adjustor, the variable attenuator receiving a first sense voltage that is a sample of said regulated output voltage, and being responsive to a variable servo signal; and c. an outer servo loop having means for providing said variable servo signal to said attenuator, the outer servo loop having an outer servo loop comparator and an outer servo loop filter, the outer servo loop comparator having a first input for receiving a second sense voltage that is a sample of an actual voltage on said lead, a second input for receiving a reference voltage, and an output, the outer servo loop comparator generating a logical high or low error signal at its output when the second sense voltage is higher or lower than the reference voltage, and the outer servo loop filter connected between the output of the outer servo loop comparator and said variable attenuator;

d. whereby said outer servo loop can sense the actual voltage on said lead and provide said variable servo signal to said attenuator which in turn provides said variable sense threshold to said inner servo loop of said switchmode voltage adjustor and causes it to adjust and compensate any fluctuation in said output voltage, and thereby provide a desirable actual voltage on said lead.

21. The invention as defined in claim 20 further comprising a fullwave rectifier and an input filter connected to said input of said voltage adjustor.

22. The invention as defined in claim 20 further comprising an output filter connected to said output of said voltage adjustor.

23. A method of regulating an output voltage of a voltage adjustor having a supply input for receiving a supply voltage, a voltage output for providing a controlled output voltage through a power distribution path to a load, and a control input responsive to a control signal for controlling the level of the output voltage as a function of the control signal, comprising the steps of:

a. providing an inner servo loop for generating the control signal for said voltage adjustor and having a sense input coupled to said voltage adjustor output, a first reference input, and a control signal output coupled to said voltage adjustor control input, where the inner servo loop establishes said voltage adjustor output level as a function of the first reference input;

b. providing an outer servo loop for generating a variable first reference voltage to said inner servo loop and having a voltage sense input coupled directly to the load for sensing an actual load voltage, a second reference input coupled to a reference voltage source, and a control signal output coupled to said first reference input of said inner servo loop, where the outer servo loop maintains control over said inner servo loop, the outer servo loop including a logical comparator for comparing the actual load voltage with the reference voltage source and providing a logical high or low error output when the actual voltage is higher or lower than the reference voltage source;

c. providing a loop filter for filtering said error output from said logical comparator to form said variable first reference voltage by a loop filter; and d. whereby said outer servo loop senses the actual regulated voltage on said load and maintains control over said inner servo loop forcing said inner servo loop to cause said voltage adjustor to adjust and compensate for any voltage losses in said power distribution path, and thereby regulate the actual voltage on said load to the desired level.

24. A method of regulating an output voltage of a voltage regulator, comprising the steps of:

a. providing an inner servo loop which has means for producing a control signal to a voltage adjustor, having an output for outputting a regulated output voltage to a load and means for comparing an inner servo loop reference voltage with a variable sense threshold from a variable attenuator, which receives a first sense voltage that is a sample of said regulated output voltage, and is responsive to a variable servo signal, and means for generating said control signal when the variable sense threshold is inconsistent with the inner servo loop reference voltage;

b. providing an outer servo loop which has means for producing said variable servo signal to said variable attenuator, and means for comparing a second sense voltage that is a sample of an actual voltage on said load with a reference voltage, and means for generating said variable servo signal when the second sense voltage is inconsistent with the reference voltage;

c. whereby said outer servo loop can sense the actual voltage on said load and provide said variable servo signal to said inner servo loop, so that said control signal produced by said inner servo loop can cause said voltage adjustor to adjust and compensate any fluctuation in said output voltage, and thereby provide a desirable actual voltage on said load.

25. A method of regulating an output voltage of a switchmode voltage adjustor having an output for outputting the regulated output voltage to a load and an inner servo loop for adjusting the output voltage, comprising the steps of:

a. providing a variable attenuator which has means for producing a variable sense threshold to said inner servo loop of said switchmode voltage adjustor, where the variable attenuator receives a first sense voltage that is a sample of said regulated output voltage, and is responsive to a variable servo signal; and b. providing an outer servo loop which has means for producing said variable servo signal to said attenuator, and means for comparing a second sense voltage that is a sample of an actual voltage on said load with a reference voltage, and means for generating said variable servo signal when the second sense voltage is inconsistent with the reference voltage;

c. whereby said outer servo loop can sense the actual voltage on said load and provide said variable servo signal to said attenuator which in turn provides said variable sense threshold to said inner servo loop of said switchmode voltage adjustor and causes it to adjust and compensate any fluctuation in said output voltage, and thereby provide a desirable actual voltage on said load.

26. A concentric servo voltage regulator comprising:

a. a voltage adjustor having an inner servo loop and an output for outputting a regulated output voltage to a load, the inner servo loop sensing the output voltage and adjusting it to a desired level;

b. an attenuator being responsive to a variable servo signal, for receiving a sample of said output voltage and providing a variable sense threshold to said inner servo loop of said voltage adjustor; and c. an outer servo loop having means for comparing a sample of an actual voltage on said load with a reference voltage, and providing said variable servo signal to said inner servo loop when the actual voltage is inconsistent with the reference voltage;

d. whereby said outer servo loop can sense said actual voltage on said load and provide said variable servo signal to said inner servo loop, so that said inner servo loop can cause said voltage adjustor to adjust and compensate any fluctuation in said output voltage, and thereby provide a desirable actual voltage on said load.

27. The invention as defined in claim 26 wherein said inner servo loop further comprises an inner servo loop comparator for comparing said sample of said output voltage and said variable servo signal.

28. The invention as defined in claim 26 wherein said outer servo loop further comprises an outer servo loop comparator for comparing said sample of said actual voltage and said reference voltage.

29. The invention as defined in claim 28 wherein said outer servo loop further comprises an outer servo loop filter connected between said outer servo loop comparator and said inner servo loop of said voltage adjustor.

* * * * *